US006779466B2

(12) United States Patent
Shabram, Jr.

(10) Patent No.: US 6,779,466 B2
(45) Date of Patent: Aug. 24, 2004

(54) COLLAPSIBLE PORTABLE FOLDING TABLE WITH FOLDING LEGS

(75) Inventor: Lyle F. Shabram, Jr., Carmel Valley, CA (US)

(73) Assignee: Batrict L. Shabram, Brentwood, CA (US)

( * ) Notice: Subject to any disclaimer, the term of this patent is extended or adjusted under 35 U.S.C. 154(b) by 100 days.

(21) Appl. No.: 10/267,182

(22) Filed: Oct. 8, 2002

(65) Prior Publication Data

US 2003/0070591 A1 Apr. 17, 2003

Related U.S. Application Data

(60) Provisional application No. 60/328,126, filed on Oct. 9, 2001.

(51) Int. Cl.[7] ..... A47B 3/00

(52) U.S. Cl. ..... 108/35; 108/115; 108/38

(58) Field of Search ..... 108/35, 36, 33, 108/34, 38, 41, 115, 118, 120

(56) References Cited

U.S. PATENT DOCUMENTS

| | | | | | |
|---|---|---|---|---|---|
| 318,779 | A | * | 5/1885 | Mehaffey | 108/36 |
| 361,729 | A | | 4/1887 | Forssell | |
| 1,846,607 | A | * | 2/1932 | Nicholas | 108/36 |
| 2,365,451 | A | | 10/1944 | Burlin | |
| 2,388,192 | A | * | 10/1945 | Bruno | 108/35 |
| 2,526,235 | A | * | 10/1950 | Morgan | 411/43 |
| 2,565,187 | A | | 8/1951 | Udell | 311/39 |
| 2,756,118 | A | | 7/1956 | Hayden | 311/87 |
| 2,903,311 | A | * | 9/1959 | Earhart | 108/34 |
| 2,967,037 | A | * | 1/1961 | Christle | 108/35 |
| 3,000,683 | A | * | 9/1961 | MacNeary | 108/116 |
| 3,110,476 | A | * | 11/1963 | Farris | 108/35 |
| 3,158,112 | A | | 11/1964 | Smith | 108/36 |
| 3,861,328 | A | | 1/1975 | Lawless | 108/115 |
| 4,043,277 | A | * | 8/1977 | Wallace | 108/35 |
| 4,389,946 | A | * | 6/1983 | Hwang | 108/115 |
| 4,444,240 | A | | 4/1984 | Bannister | 160/135 |
| 4,883,314 | A | | 11/1989 | Sakong | 297/159 |
| 4,974,526 | A | | 12/1990 | Wiygul, Jr. | 108/159 |
| 5,325,793 | A | | 7/1994 | Martin | 108/130 |
| 5,357,872 | A | * | 10/1994 | Wilmore | 108/35 |
| 5,535,683 | A | | 7/1996 | Novak | 108/36 |
| 5,540,158 | A | | 7/1996 | Ford | 108/115 |
| 5,562,051 | A | | 10/1996 | Rizzi | 108/132 |
| 5,730,066 | A | | 3/1998 | Auten et al. | 108/44 |
| 5,865,127 | A | | 2/1999 | Carter | 108/115 |
| 6,000,345 | A | | 12/1999 | Gillotti | 108/36 |
| 6,041,723 | A | | 3/2000 | Peterson | 108/115 |
| 6,182,578 | B1 | | 2/2001 | Fanuzzi | 108/36 |
| 6,192,809 | B1 | | 2/2001 | Riach et al. | 108/115 |
| 6,401,630 | B1 | | 6/2002 | Peterson | 108/12 |

* cited by examiner

*Primary Examiner*—Jose V. Chen
(74) *Attorney, Agent, or Firm*—Burns, Doane, Swecker & Mathis LLP

(57) ABSTRACT

A collapsible folding table assembly including first and second top members hingedly attached together by a first hinging device to form a foldable table top, first and second base members hingedly attached together by a second hinging device to form a foldable table base, and a plurality of foldable leg assemblies each including two or more leg sections pivotally attached together, with one end of each leg assembly being pivotally attached to one of the top members and an opposing end of each said leg assembly being pivotally attached to one of the base members, the leg assemblies being foldable in a manner so as to allow the table top to be transitioned from an extended position remote from the base to a collapsed position proximate the base, and to further allow the table top and the table base to be respectively folded about the first hinging device and the second hinging device into a compacted configuration.

18 Claims, 9 Drawing Sheets

FIG. 1
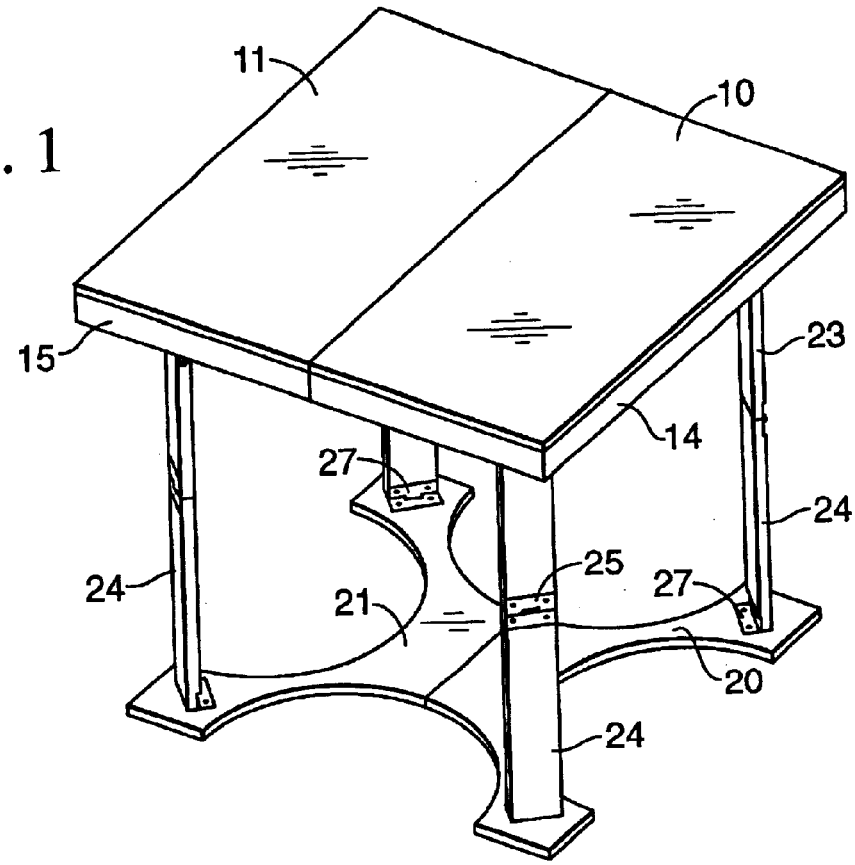
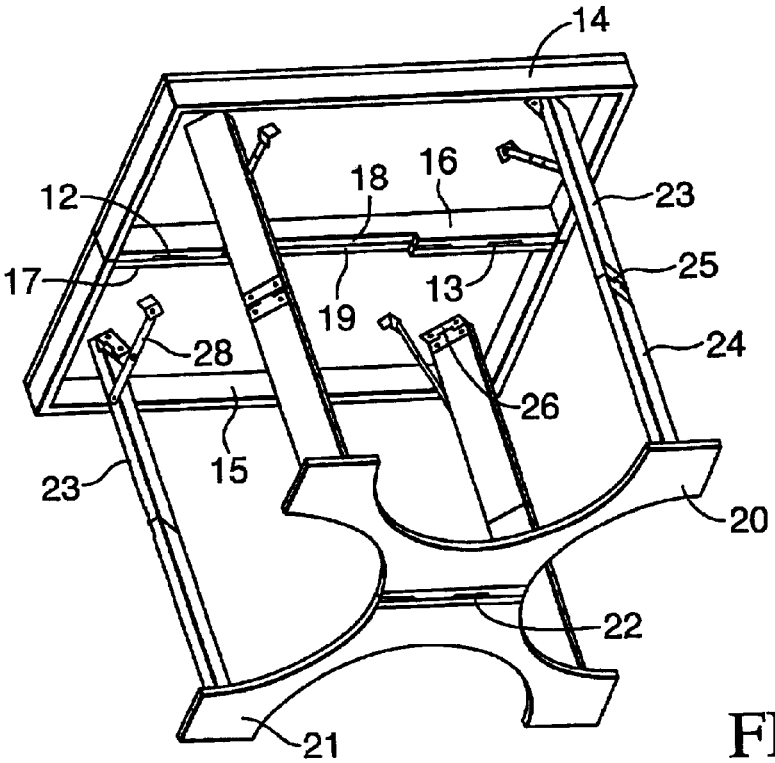
FIG. 2

COLLAPSIBLE PORTABLE FOLDING TABLE WITH FOLDING LEGS

RELATED APPLICATIONS

The present application is related to and claims priority from U.S. Provisional Application Serial No. 60/328,126, filed Oct. 9, 2001, and entitled COLLAPSIBLE PORTABLE FOLDING TABLE WITH FOLDING LEGS, the entire application being expressly incorporated herein by reference.

BACKGROUND

This invention relates to portable tables, such as card tables, camping tables, picnic tables and portable display tables that may be folded and compacted for storage or transportability. More particularly, the invention relates to a portable table that can be folded into a self-contained package that can be easily carried and stored in compact storage compartments such as those found in recreational vehicles, airplanes or small living areas.

The most common types of portable or temporary tables are generally known as card tables. The legs of a card table and similar folding leg tables generally hinge or connect to the underside of the table in a manner allowing the legs to pivot inward along one respective edge of the table to reduce the table to a substantially flat configuration essentially defined by the table top. Numerous other commonly known folding table leg configurations have been devised and used for years. Some table designs, such as the familiar ping pong table for example, combine a folding table top with folding legs. A few less commonly known tables also employ folding legs. For instance, U.S. Pat. No. 2,565,187 discloses a version of a collapsing table wherein the folding leg members pivotally connect to the table top and a base. The folding leg then allows the table to collapse vertically. U.S. Pat. No. 4,389,946 discloses a stool or table of similar workings. U.S. Pat. No. 5,535,683 discloses a carrying case convertible to a table with folding legs.

Most folding leg tables include some form of moveable or collapsible brace such as a folding scissor brace to help stabilize the table leg. The most compact portable table would require the folding of both the table top and folding or telescoping the table legs, but such a configuration poses some engineering design and stability problems, as well as problems with ease of set up.

SUMMARY OF THE INVENTION

An object of this invention is to provide a portable table that may be easily converted from a compact carryable state to a stable, sturdy table by simply opening the table top and allowing the leg assembly to fall into position.

It is also an object of this invention to provide a folding portable table with foldable legs and a foldable tabletop that compacts with the folded legs enclosed between two halves of the tabletop.

Another object of this invention is to provide a folding portable table which includes a folding table top portion, folding legs and a folding base unit where the folding legs are pivotally attached or hinged at one end to the underside of the table top and the at the other end hinged to the opposing surface of the base unit, and in this way provide a method of adjusting the height of the table.

Furthermore it is an object of this invention to provide a folding portable table with a folding table top which includes a framework around the underside of each folding section of the table top, folding table legs, and a folding base unit wherein in the folded compact state the folded legs and folded base unit are enclosed by the table top and attachment framework in a manner resembling a carry case or suitcase.

It is also an object of this invention to provide a collapsible folding table with folding legs and a folding base that, when folded, are contained within a carry case-like enclosure formed by the folding table top and frame, wherein the interior of the enclosure provides storage space for tabletop accessories such as a table cover, and wherein the case may be equipped with carry handles and closure latches.

Finally it is an object of this invention to provide a folding portable table, display gaming table, outdoor table or similar furniture that includes a foldable table top, foldable legs, a foldable base unit, and means of hinging and bracing the table legs with respect to each section of each leg, the table top and base unit.

SUMMARY

Briefly, a presently preferred embodiment of the present invention includes first and second top members hingedly attached together by a first hinging means to form a foldable table top, first and second base members hingedly attached together by a second hinging means to form a foldable table base, and a plurality of foldable leg assemblies each including two or more leg sections pivotally attached together, with one end of each leg assembly being pivotally attached to one of the top members and an opposing end of each leg assembly being pivotally attached to one of the base members, the leg assemblies being foldable in a manner so as to allow the table top to be transitioned from an extended position remote from the base to a collapsed position proximate the base, and to further allow the table top and the table base to be respectively folded about the first hinging means and the second hinging means into a compacted configuration.

Among the advantages of the present invention is that it provides a self contained, fully functional table that can be easily transported and/or stored without the use of any additional container or housing.

Another advantage of the present invention is that it provides a compact table assembly that can be unpacked by merely unfolding the "containing components" and lifting the top assembly up from the base assembly until the leg assemblies have been fully extended.

These and other objects and advantages of the present invention will no doubt become apparent to those skilled in the art after having read the following detailed description of the several embodiments illustrated in the several figures of the drawing.

IN THE DRAWING

FIG. 1 is a perspective overview of an open table made in accordance with the present invention;

FIG. 2 is a perspective underview of the open table of FIG. 1;

Figure 3A:
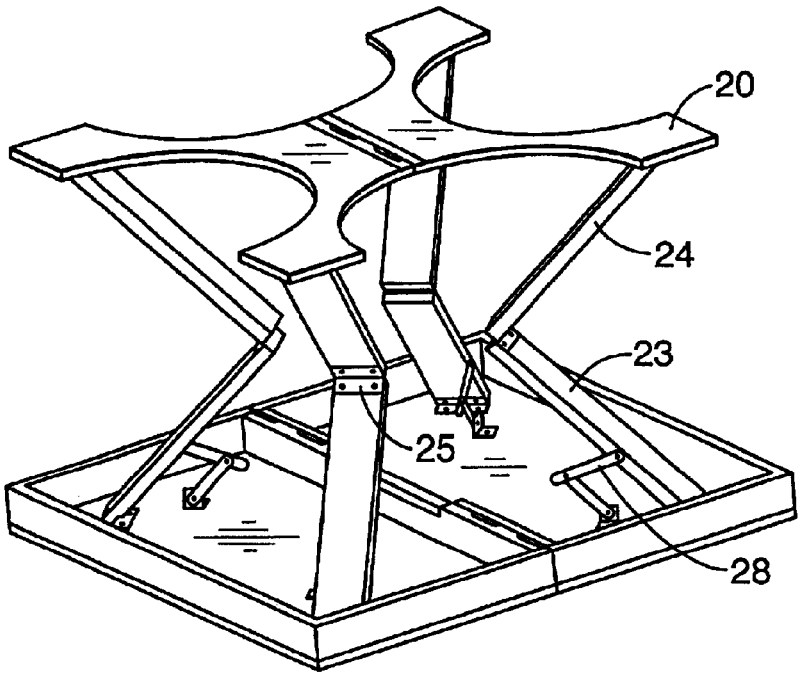
Figure 3B:
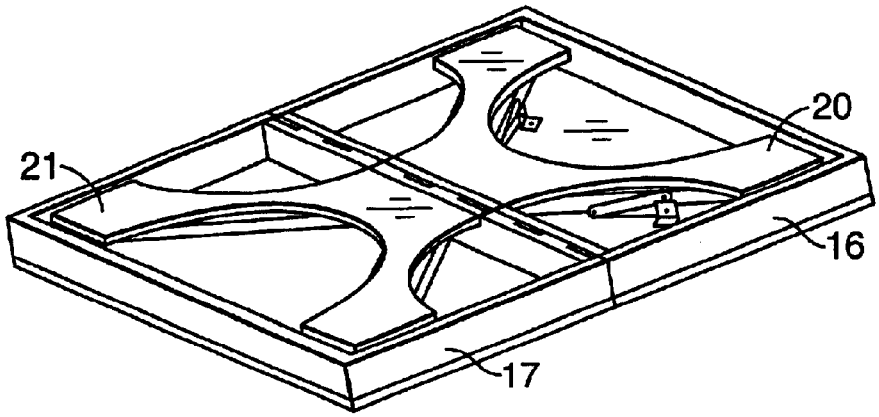
Figure 3C:
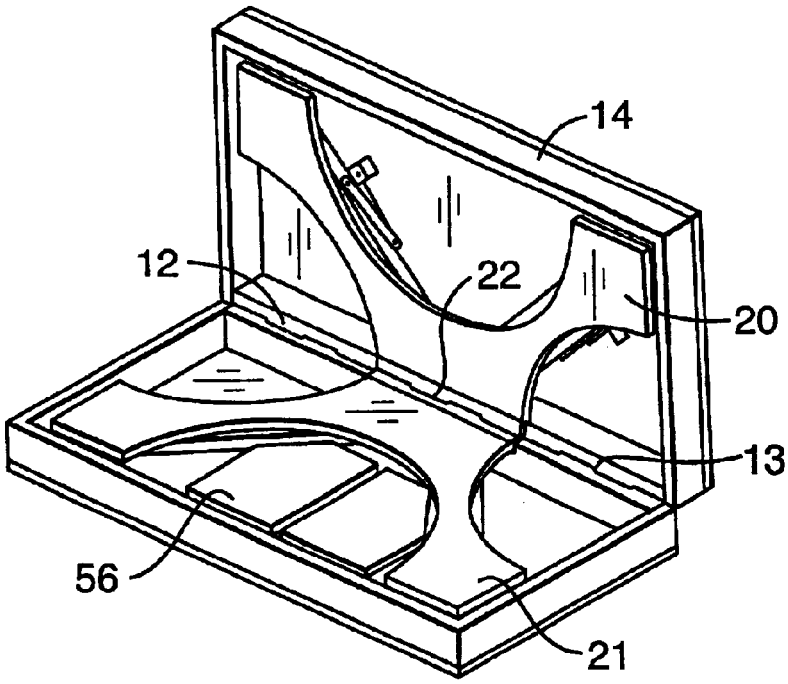
Figure 3D:
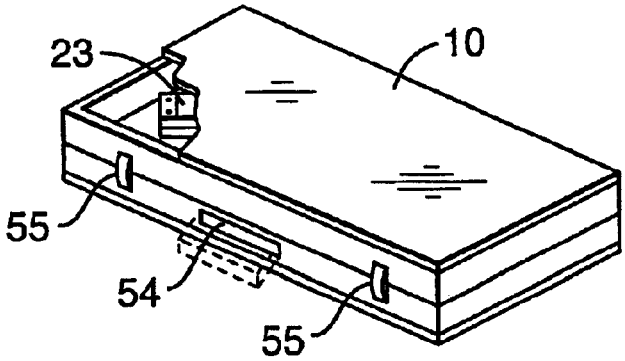
Figure 4A:
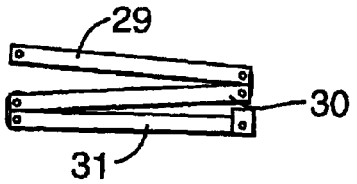
Figure 4B:
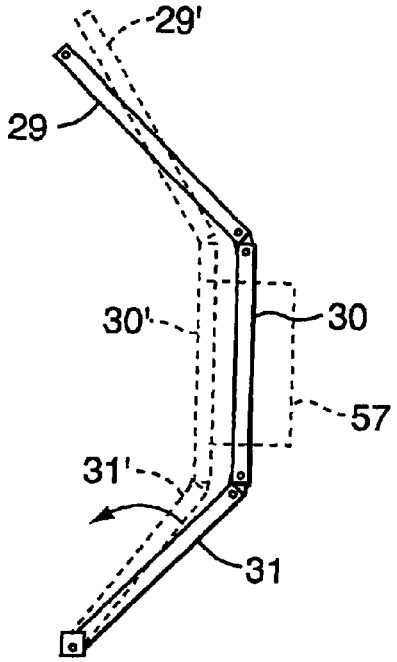
Figure 5A:
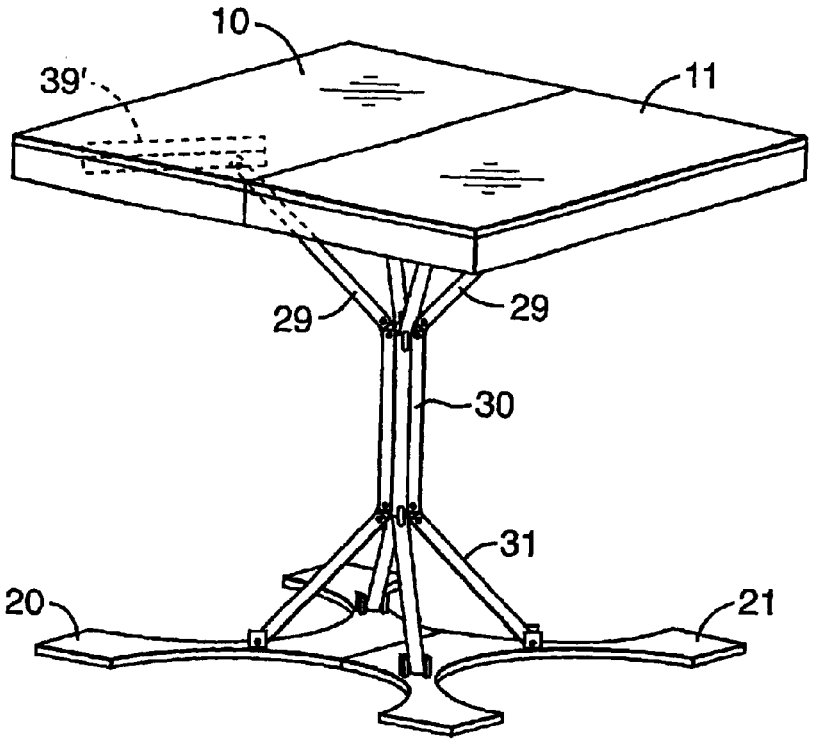
Figure 5B:
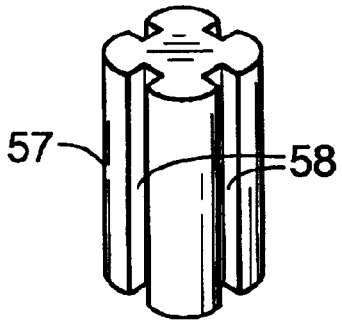
Figure 5C:
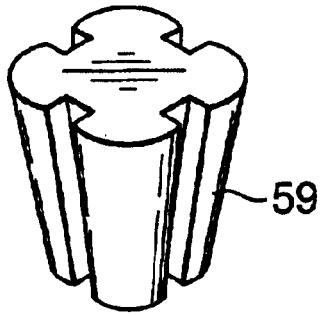

FIGS. 3*a* through 3*d* are four perspective views of the table in various stages of collapsing and folding. A cut away section in FIG. 3*d* provides exposure to part of a folded leg;

FIGS. 4*a* and 4*b* show one alternative configuration of a folding leg in the folded and extended configurations;

FIG. 5*a* is a perspective view showing an alternative embodiment of the table of the present invention including cylindrically tubular bi-folding legs;

FIGS. 5*b* and 5*c* illustrate slotted cylindrical and frustonomical inserts for placement between the legs shown in FIG. 5*a*.

Figure 5D:
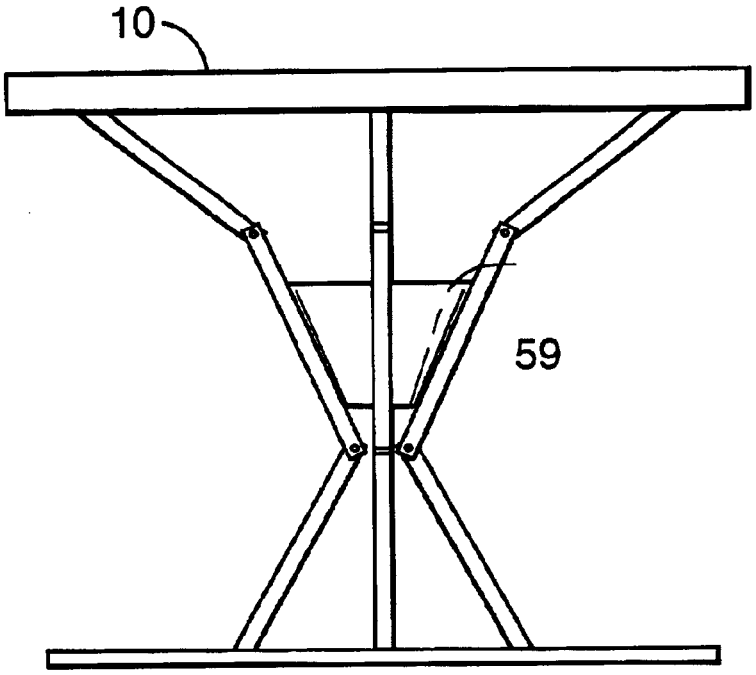

FIG. 5*d* is a side elevation of the table of FIG. 5*a* showing the insert of FIG. 5*c;*

Figure 6A:
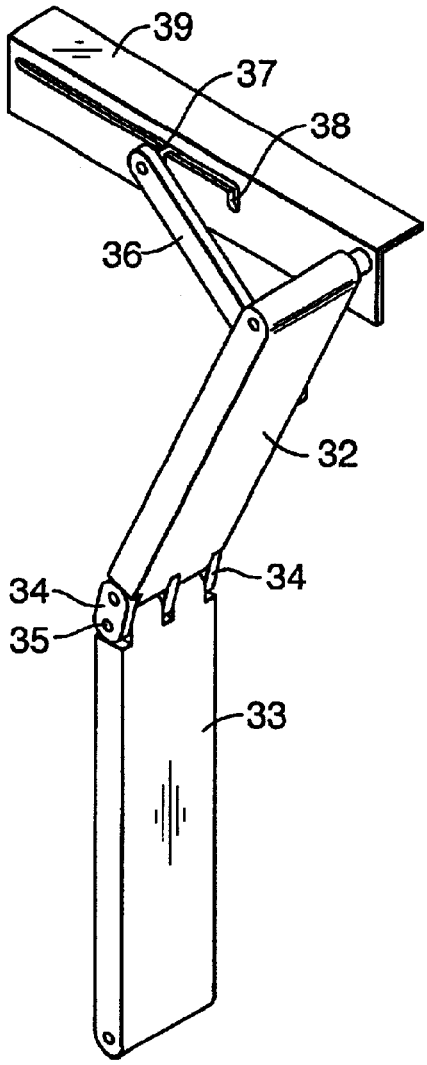
Figure 6B:
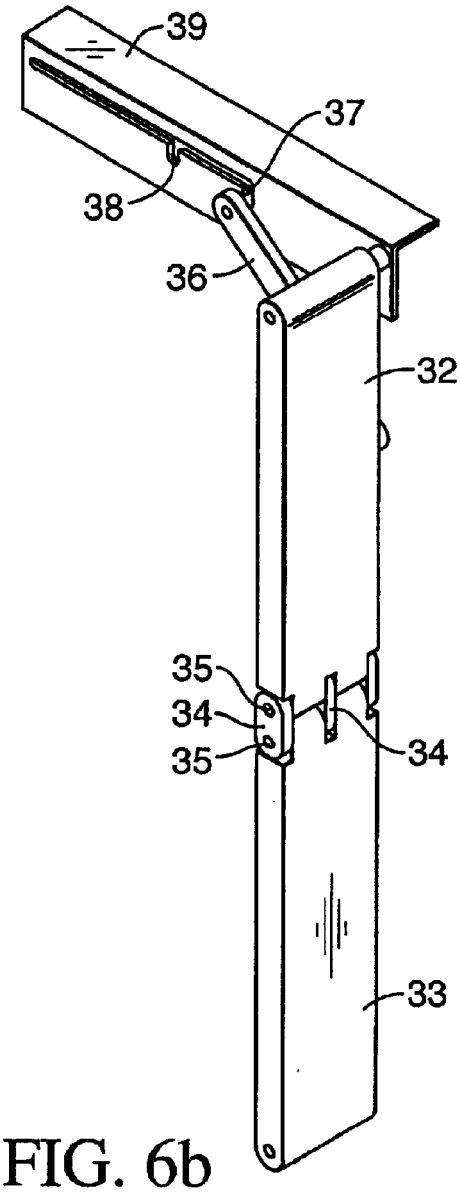
Figure 7A:
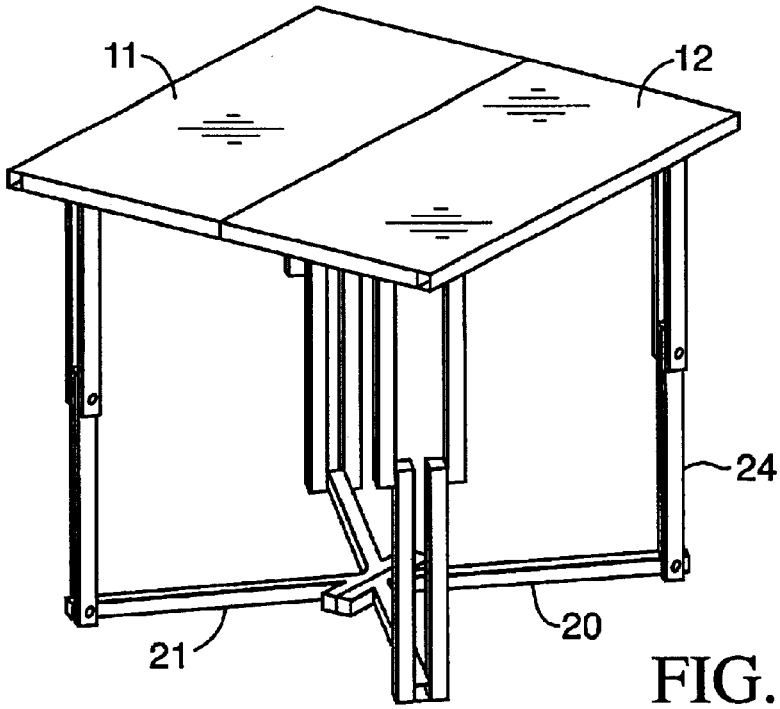
Figure 7B:
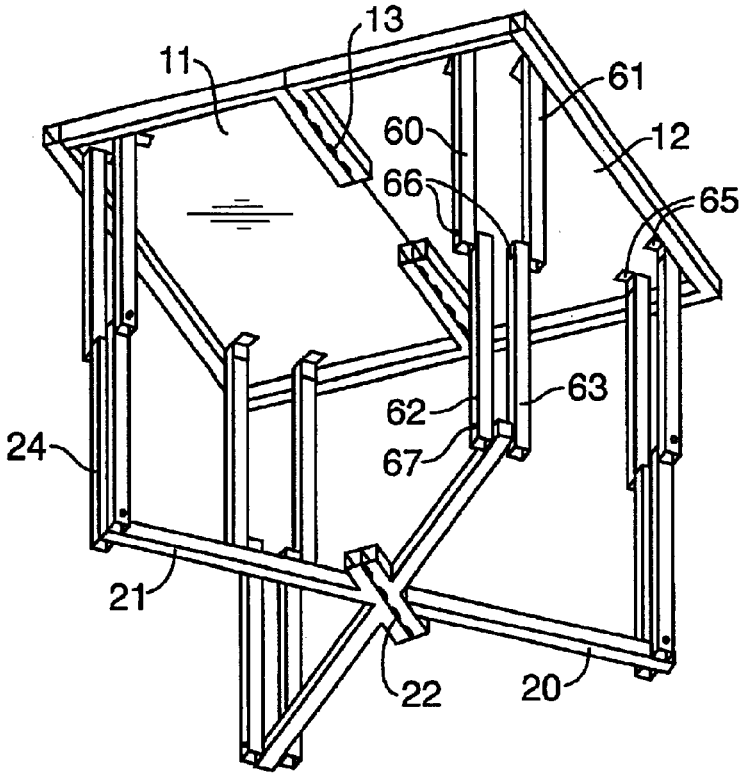
Figure 8A:
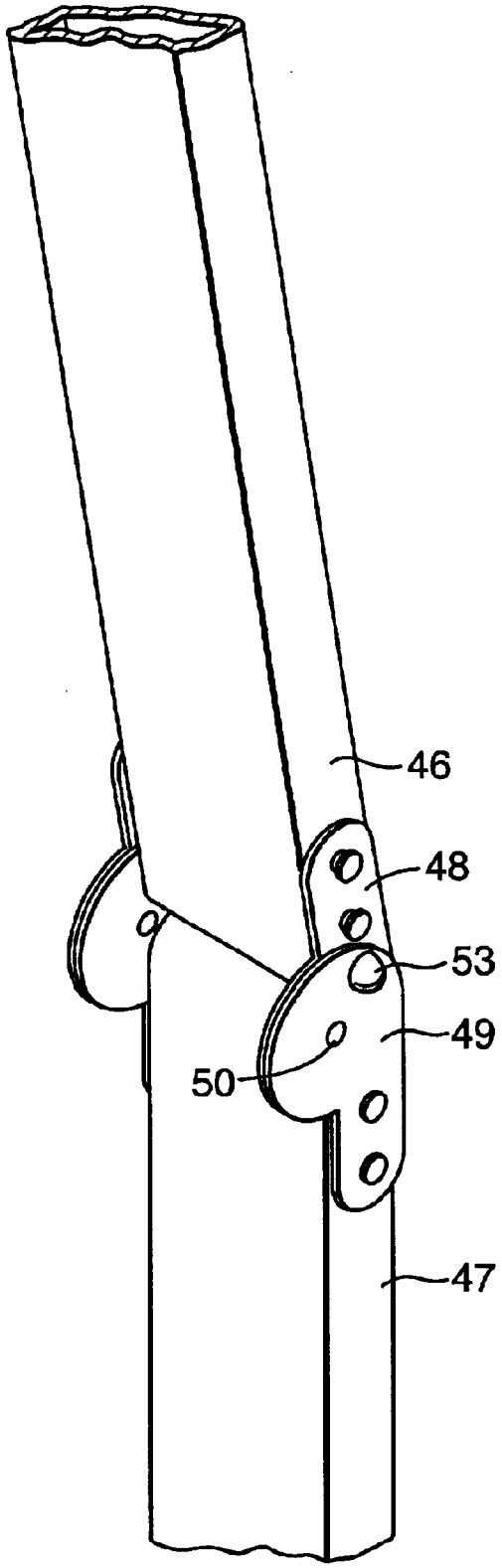
Figure 8B:
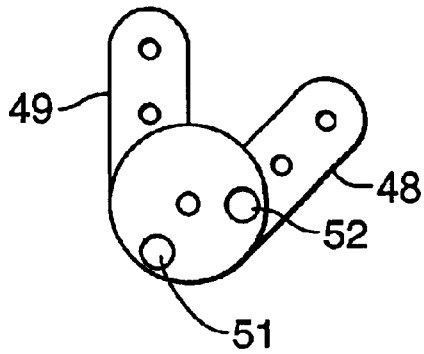
Figure 8C:
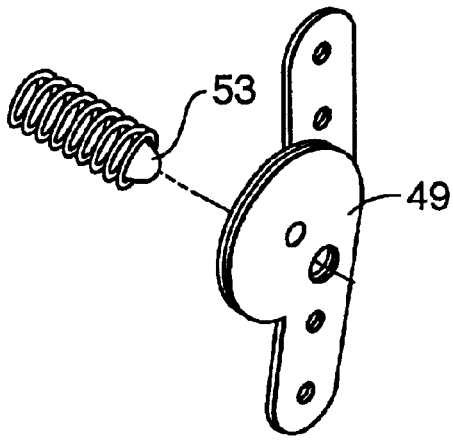
Figure 9A:
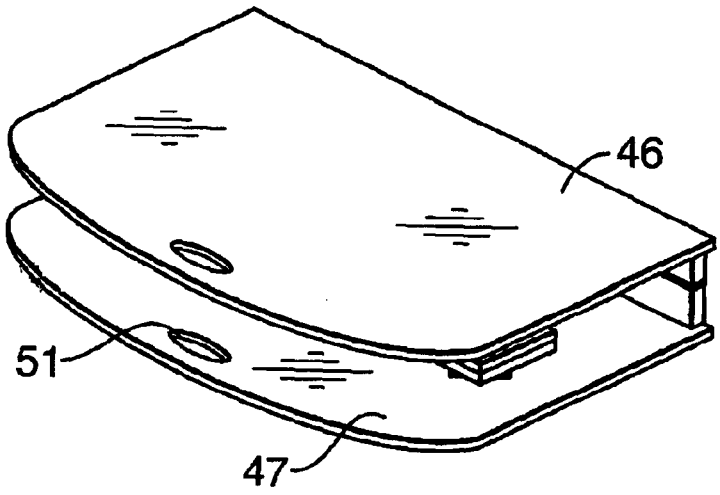
Figure 9B:
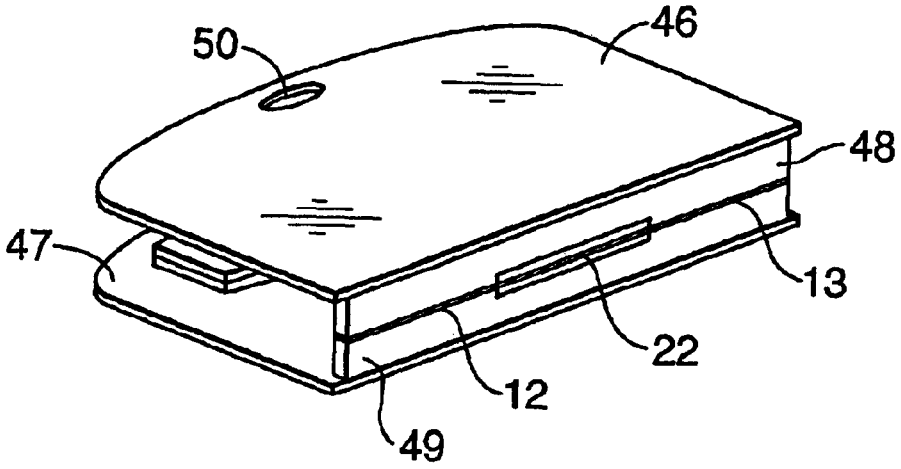

FIGS. 6*a* and 6*b* are a perspective views of a leg assembly with an alternative means of hinging and bracing the table leg at various pivoted positions;

FIGS. 7*a* and 7*b* are perspective views showing details of another alternative embodiment of the invention;

FIGS. 8*a*, 8*b* and 8*c* demonstrate a method of hinging and locking leg sections; and FIGS. 9*a* and 9*b* show two perspective views of a reconfigured folded table assembly having a top framing member on only one side.

As shown in FIGS. 1 and 2, an embodiment of the foldable table of this invention includes two top half sections 10 and 11 each of which is formal of a rectangular frame and a sheet of planar material affixed to the frame to form a table top surface. Hinges 12 and 13 (FIG. 2) are attached to sides 16 and 17 of the table top frames 14 and 15 so that the two top half sections and frames may pivot with respect to each within certain limits of rotation dictated by the configuration of the hinges and frames as follows:

Limit A represents the open state limit (FIGS. 1 and 2) where the adjacent sides 16 and 17 of frames 14 and 15 lay immediately adjacent to each other connected by hinges 12 and 13.

Limit B represents the closed state where all four edges of frames 14 and 15 lay against each other in an opposing manner (FIG. 3*d*).

Obviously in the closed state (Limit B) the frames and top sheets of material form an encasement whereas in the open state (Limit A) the two top sections form a substantially flat table top. In FIGS. 1, 2 and 3 the frames 20 and 21 each traverse the perimeter of the respective top section, thereby forming a cavity or encasement when placed edge-to-edge (FIG. 3*d*.). In an alternative embodiment, the frame members could, in fact, only traverse one edge of each top sheet resulting in a folded structure like that shown in FIG. 8 when hinged together along the edges of the frame members.

Referring now to FIG. 2 notice that hinges 12 and 13 are distally disposed along the edges of sides 16 and 17 so that the hinges do not encumber the central portion along those edges. Also note that reliefs 18 and 19 are formed between the hinges by cutting away part of this central portion of sides 16 and 17. The reliefs 18 and 19 create clearance for receiving base unit sections 20 and 21, which base unit sections are pivotally joined by a hinge 22. The base unit is geometrically configured so that when the table is in its collapsed state (with the legs folded—see FIGS. 3*b* and 3*c*) the base unit may fit into the relief (18 and 19) so that hinge 22 aligns with hinges 12 and 13. Hinges 12, 13 and 22 then work in unison so that the table top and base unit fold simultaneously, with the folded base unit 20 and 21 encased between the top sections 10 and 11 (FIGS. 3*a*–3*d*). Obviously the geometric configuration of base unit assembly 22 and 23 demonstrate only one of many possible configuration and shapes that would fall within the scope of the invention.

Focusing now on FIGS. 1 and 2, note that the four foldable legs, each including of (at least) two leg section 23 and 24 that are pivotally connected together with hinges 25 so that the sections pivot diagonally inward toward the center of the table as the table collapses. In the embodiment of the invention shown in FIGS. 1, 2 and 3*a*–*d* hinges 25 are mounted on the outside surfaces of the leg sections in such a manner that the table legs may fold to a configuration where the two leg sections lay flatly together and unfold to a limit where the two leg section form a substantially straight table leg. It should be noted that alternatively the legs sections might be configured so that in the open unfolded state the two sections do not necessarily form a straight leg.

As will be discussed below, various well known hinging and bracing methods with leg sections to form bent table legs, or permit various degrees of bending to place the table at various heights. With respect to the first embodiment, it should be further noted that leg sections 23 and 24 likewise need not be of the same length and the base unit assembly 20 and 21 could be an amount smaller in size compared to top sections 10 and 11 such that the legs sections 23 and 24 slope or bend inward when the table is fully erected. Regarding the direction that the legs fold and the configuration of the legs, the straightness of the two sections, and the cross sectional configuration of the leg sections, numerous other configurations are contemplated that fall within the scope and spirit of this invention.

As to the leg sections 23 and 24, we see in FIGS. 1 and 2 that the end of each leg section 23 opposite hinge 25 is pivotally connected to the under side of a table top section with a hinge 26, while the opposing end of leg section 24 is pivotally connected to the table base unit 20, 21 with a hinge 27. It can now be appreciated that in the collapsed state (FIG. 3*d*) the folded legs will lay between the base units 20 and 21 and the table top sections 10 and 11, and it can be further appreciated that if the stacked thickness of the leg sections and base unit are equal to or less than the depth of the sides of frames 14 and 15, and with the base unit properly seated into reliefs 18 and 19, then the top sections 10 and 11 may be folded together with the folded base unit and legs encased between the top sections. Carrying handles could be add to the outside of frames 14 and 15 and buckles or similar latches could be used to keep the folded encasement closed.

FIGS. 1, 2 and 3*a*–*d* demonstrate one of the simplest forms of the invention using standard cabinet hinges 25, 26, and 27. Also shown in these figures are four scissor braces 28 that help to stabilize the legs when unfolded. Numerous other hinging methods and bracing methods could be employed, such as the methods disclosed in FIGS. 4, 5, and 6. It should be noted, however, that the methods employed to stabilize and position each table leg is simplified and assisted by the fact that each leg is attached to base unit (20 and 21). The base unit serves the multiple purposes of helping to stabilize the leg, maintaining the integrity of the position of each leg, and simplifying the erecting of the table from the collapsed state.

In FIG., 3*d* a retractable handle is shown at 54 that may be conveniently used to carry the table assembly when it is in its closed or compacted configuration and is held in the configuration by recessed latches 55. Any suitable form of latch and carry handle may be used on any of the several embodiments disclosed herein.

FIG. 5*a* illustrates an alternative embodiment of the invention with a variation in the configuration of the legs and associated folding and hinging method. This embodiment erects into a table resembling a pedestal table. In FIG. 5*a* each leg assembly includes three folding sections 29, 30 and 31, which fold in either direction. FIGS. 4*a* and 4*b* demonstrate the folding sequence for each leg, which "Z" folds into the compact state. The hinging method for each section is somewhat similar to the method disclosed in FIGS. 6*a* and 6*b* except that its upper attachment points must slide from an inner, "deployed," position to an outer "retracted," position so as to accommodate the affect of the linkage end points (see FIG. 4*a*) when the sections are in the folded configuration. A notched slot or tract 39' similar to that shown at 39 in FIGS. 6*a* and 6*b* may be used.

Leg sections with a round cross section are used to further demonstrate variations of the invention. One unique feature of this configuration shown in FIG. 5*a* is that in the erect table state all of the central leg sections 30 forcibly meet at the central location creating a stable limitation for the otherwise collapsing table. Providing suitable clips, pins or latches for latching all four legs together eliminates the need for additional braces between the leg and the top sections. In addition, a cylindrical insert 57 having leg receiving slots 58 as shown in FIG. 5*b* might be interposed between the legs to raise the table height to an elevation higher than that illustrated in FIG. 5*a* as suggested by the dashed lines 29', 30' and 31' in FIG. 4*b*.

If slotted tracks 39' are not used to allow the upper ends of the legs to slide inwardly as the table is transitioned from its closed or compacted configuration to its open or extended configuration, and the upper leg ends are hingedly attached at a fixed position, it may be necessary to provide a frusto-conical spacer 59 or spreading mechanism as suggested in FIG. 5*d* to stabilize the legs.

To collapse the table, the legs must first be extended (forcing the top sections and base unit apart) then caused to pivot outward at the base unit. In addition, the upper leg end must be freed to move outwardly toward the corresponding table corner.

In FIGS. 6*a* and 6*b* an alternative hinging method is depicted along with an alternative bracing method that latches at various positions. The hinging method is comprised of a plurality of hinge plates 34 each with two apertures to receive hinge posts 35. The hinge posts or pins 35 also extend through the rounded ends of leg sections 32 and 33. This hinging method allows pivoting in two locations such that 33 can pivot relative to 34 and 34 can pivot relative to 32. This allows either leg section to pivot a total 180 degrees in either direction. One additional feature of this hinging method is that it nearly eliminates the possibility that hands, finger, or other objects could be caught or pinched between the ends of the leg sections. The conventional hinging method of FIGS. 1,2 and 3*a–d* does not have this advantage.

Also shown in FIGS. 6*a* and 6*b* is a pivot pin or a brace 36 that is pivotally attached to leg section 32. At the opposite end of brace 36 is post 37 extending from brace 36 and through a slot 38 in bracket 39. The slot 38 is configured with a plurality of notches, which may receive post 37 to hold the leg in a selected position. As can be seen in the two figures, leg section 32 can be pivoted to various degrees where the post 37 coincides with one of the notches in slot 38. When the post is seated into a particular notch 38, the leg section 32 will remain in that relative position. This method of locking the position of leg section 32 could be employed to keep the collapsible table of this invention in one or more erect positions.

FIGS. 7*a* and 7*b* respectively illustrate perspective views showing details of another alternative embodiment of the invention from upper and lower angles. This embodiment is particular suited for manufacture from any of a variety of materials including wood, plastics and metals. As in previous embodiments it includes folding top surface forming members 11 and 12, folding base forming members 20 and 21, and a plurality of folding leg members 24. The top members and base members are hingedly joined together by hinges 13 and 22 respectively. The legs in this embodiment differ from the previous embodiments in that they are each comprised of four elongated elements 60–63. The upper ends of elements 60 and 61 are hingedly attached to the bottom of a top member by suitable hinges 65 while the lower ends thereof are pivotally connected to the upper ends of elements 62 and 63 by pivot pins 66. The lower ends of elements 62 and 63 are pivotally connected to a base member by a pivot pin 67. As will be appreciated, the table can be collapsed by folding it such that as the top members move toward the base, the base member folds into a nesting relationship with the lower leg elements 62 and 63 which in turn fold into a similar relationship with the upper leg elements 60 and 61 as the latter elements fold into place against the bottom surface of a top member. With the table so collapsed, the assembly can be folded into its compacted configuration by rotating the top members about the hinges 13 and the base members about the hinges 22.

This table design can easily be manufactured using solid wood on extruded tubular plastic or metal stock for the legs, top frame and base, and using sheet material to form the top surface. The several parts can be joined together as depicted using readily available hinges and pivot pin devices.

FIGS. 8*a–8c* demonstrate another alternative method of hinging and locking the table leg sections. Experimental models of the table have shown that a locking mechanism in the hinged connection between the table leg sections is all that is needed to stabilize and secure the table in its open position. As shown in these figures, the leg sections 46 and 47 and respective hinge plates 48 and 49 are pivotally connected by rivets 50. Aperture 51 in plate 49 and aperture 52 in plate 48 (FIG. 9*b*) will align when the hinge plates (and leg sections to which they are attached) are rotated to an open position, and there allow a spring loaded detent 53 to snap through both apertures thereby locking the legs in position. To release the hinge, the detent may be depressed until hinge plate 49 may rotate relative to 48. This type of locking mechanism is commonly used in other applications such as extension poles for tents and the like. The tip of the detent is rounded off to facilitate engaging and releasing actions.

FIGS. 9*a* and 9*b* disclose yet another configuration of the invention (shown in a collapsed and folded state), which demonstrates that frame members 46 and 47 need only traverse the hinged side of the reconfigured top section 48 and 49. Also show in FIGS. 9*a* and 9*b* are cutouts 50 and 51 which may serve as handle grips for carrying the table assembly.

Referring again to the embodiments shown in FIGS. 1–5 it should be noted that the hinging configuration joining the top sections 10 and 11, and the base sections 20 and 21 are chosen as a matter of preference or convenience. For instance, the hinging configuration could be reversed so that there is a single hinge centrally placed along the frame edges and two separated hinges connecting the base unit. Similarly, the geometric configuration of the base unit and relieved areas in the table top frame could be changed accordingly to accomplish the same results. Certainly numerous configurations could be conceived of for the shape of the base unit and table top section. Even a round table top is conceivable, and, in fact, the hinging method (piano hinges shown) could be changed to any usable known method including a variation of the hinging method shown in FIGS. 6*a–6d*. If no particular advantage can be realized by using an alternative hinging method or geometric configuration of the component parts of the invention, it does not lessen the fact that such configurations and methods fall within the scope and spirit of this invention.

If, for instance, a hole were cut through the center of the top sections and through the center of the base unit, then the erected table could be equipped with an umbrella like a patio table. Another alteration might involve imprinting or inlaying designs in the table top section such as a chess board, thereby enhancing the table as a gaming table. The invention herein disclosed may be made of any suitable material (such as plastic, aluminum, steel, wood, etc.) and may be utilized in many ways (card table, display, desk, stool, outdoor table, etc.). Moreover, even though described above as including discrete hinge devices, it is contemplated that the table assembly could be fabricated by injection molding with at least some of the hingedly attached component parts joined together by integrally molded "living hinges."

Although the present invention has been described in terms of several alternative embodiments, it is anticipated that still other alterations and modifications will become apparent to those skilled in the art after having read the above disclosure. It is therefore intended that such disclosure be considered illustrative and not limiting, and that the appended claims be interpreted to include all such alterations, modifications and embodiments as fall within the true spirit and scope of the invention.

What is claimed is:

1. A collapsible folding table assembly, comprising:

first and second top members hingedly attached together by a first hinging means to form a foldable table top;

first and second base members hingedly attached together by a second hinging means to form a foldable table base; and a plurality of foldable leg assemblies each including two or more leg sections pivotally attached together, with one end of each leg assembly being pivotally attached to one of said top members and an opposing end of each leg assembly being pivotally attached to one of said base members, said leg assemblies being foldable in a manner so as to allow the table top to be transitioned from an extended position remote from the base to a collapsed position proximate the base, and to further allow the table top and the table base to be respectively folded about the first hinging means and the second hinging means into a compacted configuration.

2. A collapsible folding table assembly as recited in claim 1 wherein said leg assemblies include means for securing said leg sections in an extended position.

3. A collapsible folding table as recited in claim 1 wherein said top members include planar rectangular sheets of material affixed to bordering frames such that when said table assembly is in said compacted configuration said sheets of material and said frames define an envelope enclosing said legs and said first and second base members.

4. A collapsible folding table assembly as recited in claim 3 wherein said first hinging means is attached to one side of the bordering frame of both said top members.

5. A collapsible folding table assembly as recited in claim 4 wherein said one sides of said bordering frames are relieved to receive second hinging means and the hinged together extremities of said first and second base members when said table assembly is in said compacted configuration.

6. A collapsible folding table assembly as recited in claim 1 wherein said foldable table base when in its unfolded configuration is generally X shaped.

7. A collapsible folding table assembly as recited in claim 3 and further comprising handle means affixed to at least one of said frames to facilitate carriage of said table assembly when it is in said compacted configuration.

8. A collapsible folding table assembly as recited in claim 7 and further comprising latching means affixed to said frames to lock said table assembly in said compacted configuration.

9. A collapsible folding table assembly as recited in claim 1 wherein each said leg assembly includes 3 elongated leg sections hingedly joined together to form a series linkage having an upper end hingedly affixed to one of said top members and a lower end hingedly affixed to one of said base members.

10. A collapsible folding table assembly as recited in claim 9 wherein the upper end of each said leg assembly is affixed to its associated top member by a bracket having an elongated slot for receiving a pivot pin affixed to the upper end of said leg assembly, said pin being pivotal within and slideable along said slot as said table assembly is transitioned between said extended position and said collapsed position.

11. A collapsible folding table assembly as recited in claim 10 wherein said slot includes one or more pin receiving notches for holding the upper end of said leg in a particular position along the length of said slot.

12. A collapsible folding table assembly as recited in claim 9 and further comprising stabilizing means for securing the middle leg sections of said leg assemblies in fixed positions relative to each other when said table top is in said extended position.

13. A collapsible folding table assembly as recited in claim 1 wherein each said first hinging means includes a bracket to which a corresponding foldable leg assembly is pivotally affixed, and having a longitudinally extending slot formed therein, and bracing means having one end affixed to said corresponding leg assembly and an opposite end having a post selectively slideably or lockingly engaging said slot to hold said corresponding leg assembly in a selected position.

14. A collapsible folding table assembly as recited in claim 1 wherein said means for securing said leg sections in an extended position includes hinges having spring loaded detent means adapted to lockingly engage detent receiving apertures when said leg assemblies are in a predetermined unfolded configuration.

15. A collapsible folding table assembly as recited in claim 1 wherein said leg assemblies are made of tubular material.

16. A collapsible folding table assembly as recited in claim 1 wherein said leg assemblies are made of extruded plastic material.

17. A collapsible folding table assembly as recited in claim 1 wherein said leg assemblies are made of wood.

18. A collapsible folding table assembly as recited in claim 1 wherein said leg assemblies are made of metal.

* * * * *